US005570165A

United States Patent [19]

Koike

[11] Patent Number: 5,570,165

[45] Date of Patent: Oct. 29, 1996

[54] METHOD OF CONTROLLING TONER DENSITY DETECTION

[75] Inventor: Tadao Koike, Tokyo, Japan

[73] Assignee: Ricoh Company, Ltd., Tokyo, Japan

[21] Appl. No.: 394,818

[22] Filed: Feb. 27, 1995

[30] Foreign Application Priority Data

Feb. 25, 1994 [JP] Japan ..... 6-027633

[51] Int. Cl.[6] ..... G03G 21/00

[52] U.S. Cl. ..... 355/246; 355/204; 355/208; 355/271; 355/273

[58] Field of Search ..... 355/246, 208, 355/203, 204, 271, 277, 214, 273; 430/30

[56] References Cited

U.S. PATENT DOCUMENTS

| | | | |
|---|---|---|---|
| 4,785,331 | 11/1988 | Oka et al. | 355/208 |
| 4,894,685 | 1/1990 | Shoji | 355/246 |
| 5,083,160 | 1/1992 | Suzuki et al. | 355/208 |
| 5,148,224 | 9/1992 | Yamada et al. | 355/271 |
| 5,258,248 | 11/1993 | Tokuhashi et al. | 430/30 X |
| 5,307,119 | 4/1994 | Folkins et al. | 355/208 |
| 5,333,037 | 7/1994 | Inoue et al. | 355/203 |

FOREIGN PATENT DOCUMENTS 60-146256 8/1985 Japan .

*Primary Examiner*—Matthew S. Smith

*Attorney, Agent, or Firm*—Oblon, Spivak, McClelland, Maier & Neustadt, P.C.

[57] ABSTRACT

A method and an apparatus for controlling toner density detection in an electrophotographic-type image forming apparatus in which the control of various parts can be performed easily, the image forming process can be effectively done without deteriorating the productivity of the copying operation, the number of contacting/detaching operations of the transferring belt apparatus can be made small (minimized), and the toner can be prevented from dispersing whereby the reliability of controlling the toner density detection can be raised. In such a method and apparatus for controlling the toner density detection, the time interval of the transferring process is established to either a long interval or a short interval. When the time interval of the transferring process is the long interval, a transferring belt apparatus is detached from a photosensitive body, a standard density pattern is formed on the photosensitive body, and the density of the standard density pattern is detected by a density detecting unit. On the contrary, when the time interval of the transferring process is the short interval, the above-mentioned standard density pattern is not formed at all.

13 Claims, 11 Drawing Sheets

METHOD OF CONTROLLING TONER DENSITY DETECTION

BACKGROUND OF THE INVENTION

1. Field of the Invention

The present invention relates to method of controlling toner density detection in an electrophotographic-type image forming apparatus such as a copying machine, printer, facsimile device, etc.

2. Description of the Background

Generally, in an electrophotographic-type image forming apparatus such as a copying machine, printer, facsimile device, etc., the image forming process is carried out in such a manner so that a photosensitive body including a drum-shaped photosensitive body, a belt-shaped photosensitive body, or the like, is rotated by a motor, an electrostatic latent image is formed by performing a uniform charging and an image is exposed on the photosensitive body by use of latent image forming means including charging apparatus and exposing means. The electrostatic latent image is converted to a visible toner image by developing the latent image by a developing apparatus, and the toner image thus formed is transferred onto copying paper supplied from a paper supplying apparatus by use of a transferring apparatus. The transferred toner image is fixed on the paper by use of a fixing apparatus, and the photosensitive body is cleaned by a cleaning apparatus after transferring the toner image.

And further, regarding such an electrophotographic-type image forming apparatus, a method of making the time interval of the image forming process (approximately same as that of the transferring process) longer than the standard interval when the toner density becomes equal to or lower than a predetermined level has already been described in the published patent specification of Japanese Laid-open Patent Publication No. 63-243980/1988. Furthermore, in the above-mentioned electrophotographic-type image forming apparatus, another method of delaying the timing of supplying the copying paper or temporarily stopping the image forming operation when the density of toner employed as developing agents accommodated in the developing apparatus is described in the published patent specifications of Japanese Laid-open Patent Publication Nos. 63-287978/1988, 63-287979/1988, 63-287980, etc.

In the recent years, in the electrophotographic-type image forming apparatus represented by the copying machine, a transferring belt apparatus including a resilient endless belt made of a resistor having a medium resistance value generating a small amount of ozone and capable of performing preferable transferring over entire copying paper has been utilized. The above transferring belt apparatus includes a transferring belt contacting with and detaching from the photosensitive body by action of the driving portion's rotational driving and transferring bias applying means for applying the transferring bias voltage to the transferring belt. At the time of transferring, the transferring belt comes into direct contact with the photosensitive body, and the transferring bias voltage is applied to the transferring belt from the transferring bias voltage applying means, so that the toner image on the photosensitive body is transferred onto the copying paper passing through the nipping portion between the transferring belt and the photosensitive body.

And further, in relation to the method of detecting the toner density in order to control the density of toner employed as the developing agents in the developing apparatus, there has been adopted a method of employing the combination of an optical sensor (called a "P-sensor", hereinafter) for detecting the reflection density of a standard density pattern (called "P-sensor pattern", hereinafter) formed on the photosensitive body and a magnetic sensor (called a "T-sensor pattern", hereinafter) for assuming the toner density by detecting the magnetic permeability of the developing agents accommodated in the developing apparatus. Conventionally, the P-sensor has been disposed at the downstream side of the developing apparatus. However, in order to avoid a defect caused by the dispersing toner from the developing apparatus, the P-sensor is disposed preferably at the lower portion of the cleaning apparatus, namely, at the downstream side of the transferring belt apparatus, instead of the downstream side of the developing apparatus.

SUMMARY OF THE INVENTION

One object of the present invention is to provide a novel electrophotographic-type image forming apparatus with good image forming characteristics.

All of the methods described in the above-mentioned specifications of Japanese Laid-open Patents (Patent Applications) aim at performing the operation of image forming at the predetermined toner density by earning the time until recovering the toner density respectively. However, the time required for forming the image per one sheet of paper then becomes long, which results in the inferior productivity of the object forming image thereon.

Furthermore, concerning the above-mentioned electrophotographic-type image forming apparatus employing the transferring belt apparatus, in case that the P-sensor is disposed at the downstream side of the transferring belt apparatus, it is necessary to transfer the P-sensor pattern onto the transferring belt apparatus and not to remove the P-sensor pattern therefrom in order to detect the reflection density of the P-sensor pattern developed on the photosensitive body. Namely, the transferring belt needs to be kept in a state of being detached from the photosensitive body. In general, it is necessary to perform the detection of the reflection density of the P-sensor pattern by P-sensor per image formation for several sheets of paper. Consequently, it is necessary to construct the image forming apparatus such that the apparatus performs the operation of causing the transferring belt to contact with and detach from the photosensitive body per each process of image forming (per each process of transferring), or such that the apparatus performs the operation of separating the transferring belt from the photosensitive body at least at the time of detecting the reflection density of the P-sensor pattern.

However, regarding such electrophotographic-type image forming apparatus, there happens sometimes a case that the time interval of the image forming process at the time of repeating for successively performing the image forming operation (the time interval of transporting the transferring paper) is short, and thereby the P-sensor pattern cannot be formed on some occasions. Therefore, there arise the following problems to be solved:

(1) How to establish a method of controlling the formation of the P-sensor pattern and the transferring belt apparatus in a case that the time interval of the image forming process is comparatively short;

(2) How to effectively perform the image forming process and thereby keep superior productivity of the object forming image thereon;

(3) How to make the repetitive times of the contacting/detaching operation of the transferring belt apparatus as small as possible, and how to raise the reliability of the image forming apparatus; and (4) How to establish the procedure of the image forming process at the time of repeating which can be easily controlled.

The present invention is made in consideration of the above-mentioned actual circumstances. And it is an object of the present invention to solve the points at issue as mentioned heretofore.

It is another object of the present invention to provide an electrophotographic-type image forming apparatus improved in the aforementioned points at issue.

It is still another object of the present invention to provide an improved method of controlling toner density detection in such an electrophotographic-type image forming apparatus.

It is still another object of the present invention to provide an improved method of controlling the toner density detection capable of effectively performing the image forming process with a simple control operation without degrading the productivity of the object forming image thereon.

It is still another object of the present invention to provide an improved method of controlling the toner density detection capable of reducing the repetitive times of contacting/detaching of the transferring belt apparatus, preventing the toner from dispersing from the developing apparatus, and thereby raising the reliability of the image forming apparatus.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
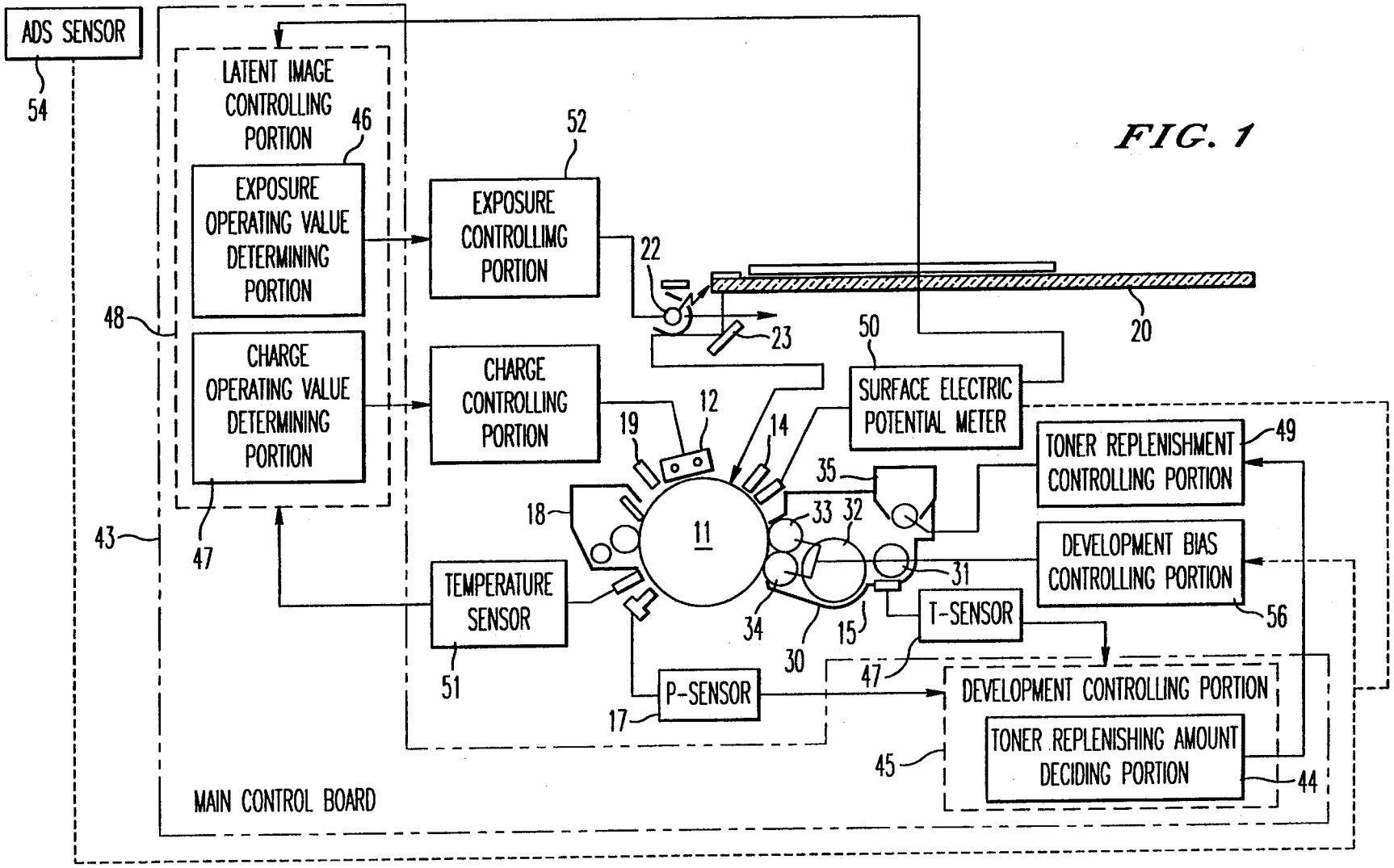
FIG. 1 is an outlined structure diagram showing a first example of a copying machine applying first and second embodiments of the present invention.
Figure 2:
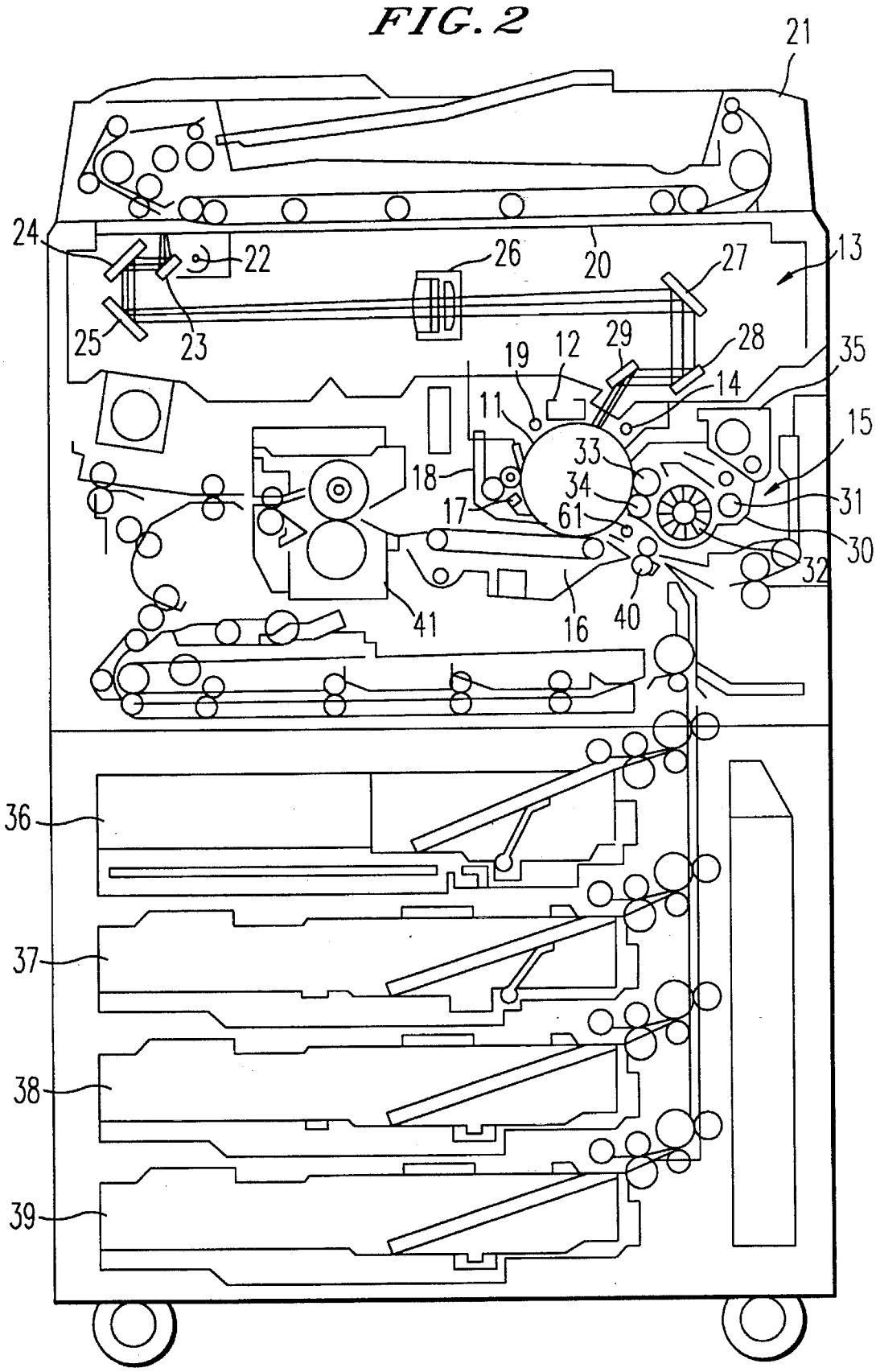
FIG. 2 is a cross-sectional view of the first example of the copying machine shown in FIG. 1.

The embodiments of the present invention control toner density detection in connection with an image forming operation in an electrophotographic-type image forming apparatus which includes a transferring belt apparatus and a P-sensor, or comprising a transferring belt apparatus, a P-sensor and a T-sensor. FIGS. 1 and 2 show a first example of an electrophotographic image forming apparatus constructed as an example electrophotographic copying machine applying the first and second embodiments of the present invention.

Around a photosensitive body, for instance, a drum-shaped photosensitive body 11, there are arranged, in order, charging means 12 constructed with a charger employed in the electrophotographic process, exposing means 13, eraser 14, developing means 15 constructed with a developing apparatus, transferring separation means 16 constructed with a transferring belt apparatus, a density detector (P-sensor) 17 constructed with a reflection-type optical sensor, a cleaning apparatus 18, and electricity removing means 19 constructed with an electricity removing lamp, in the rotational direction of the photosensitive body 11. In such a construction, the charging means 12 and the exposing means 13 form latent image forming means.

At the time of the image forming operation (copying operation), the photosensitive body 11 is rotatably driven by a main motor and is uniformly charged by the charger 12, and the image exposure is done by the exposing means 13, and thereby the electrostatic latent image is formed. The light source 22 in the exposing means 13 is constructed with an exposing lamp and illuminates a manuscript document set on a manuscript stand 20 by an automatic manuscript conveying apparatus 21 or by hand and focuses the image of the reflected light rays onto the photosensitive body 11 through mirrors 23–25, a lens 26, and mirrors 27–29, and at the same time, the movable optical system 22–25 is reciprocated in order to scan the manuscript document. The movable optical system 22–25 returns to a home position thereof after scanning of the manuscript document is terminated.

And further, it may be permitted that the exposing means 13 comprises a manuscript document reading-out apparatus for reading out the manuscript document and an opto-electric converting means for converting the image signal emitted from the manuscript document reading-out apparatus to an optical signal and radiating the converted signal onto the photosensitive body 11. Otherwise, it may be also permitted that the exposing means 13 comprises only an opto-electric converting means.

The electric charge on the unnecessary area is removed by the eraser 14 after forming the electrostatic latent image, and the electrostatic latent image is developed to form a toner image by use of the developing apparatus. In the developing apparatus 15, two-component developer in developer container 30 containing toner and carrier is agitated by agitating members 31 and 32 and circulates in the developer container 30. Developing sleeves 33 and 34 are arranged to face the photosensitive body 11 and to magnetically attract the developer by the action of the magnet contained therein and thereby the same form a magnetic brush. The magnetic brush is transported accompanying the rotation of the agitating members 31 and 32 and the circulation of the developer. The electrostatic latent image on the photosensitive body 11 is converted to the toner image by developing the latent image by use of the developer transported through the narrow space between the photosensitive body 11 and the developing sleeves 33 and 34. Toner replenishing apparatus 35 replenishes toner into the developer in the developer container 30.

The electric charge on the surface of the photosensitive body 11 is removed by a pre-transferring electric charger removing member 61 after developing the electrostatic latent image by use of the developing apparatus 15. And further, the copying paper is supplied to registration roller 40 from a selected one of paper supplying apparatuses 36 through 39. The registration roller 40 sends out the copying paper matching with the toner image on the photosensitive body 11. The toner image formed on the photosensitive body 11 is transferred onto the copying paper conveyed from the registration roller 40 by use of the transferring belt apparatus 16 after the operation of removing the electric charge by the action of pre-transferring charge removing element 61, and the transferred copying paper is separated from the photosensitive body 11 and is further conveyed. The transferred copying paper transported by the transferring belt apparatus 16 is fixed with the toner image by use of the fixing apparatus 41 and is discharged thereafter as copied paper.

Such a copying operation is initiated by pushing the start switch of the operation board and is repetitively performed successively per number of the paper sheets to be copied as previously set on the operation board.

FIG. 1 further shows a control system of a first example of the embodiments according to the present invention.

In order to perform variable control so as to stabilize the developing ability of the developing apparatus 15, the first example of the present invention employs a P-sensor 17 for optically detecting the reflection density of the toner image of the P-sensor pattern on the photosensitive body 11, and toner density detecting means 42 constructed with a magnetic sensor (T-sensor) assuming the toner density of the developer by detecting the permeability of the developer in the developing apparatus 15 (the permeability of the developer varies in accordance with the mixing ratio of the carrier made of the magnetic substance in the two-component developer and the toner made of resin).

Control means 43 is constructed with a main control board and includes a development controlling portion 45 including a determination part 44 for determining the amount of replenishing toner and a latent image controlling portion 48 including an exposure manipulating value determining portion 46 and a charge manipulating value determining portion 47. The development controlling portion 45 combines the output value of the P-sensor 17 with the output value of the T-sensor 42, and the toner replenishing amount determining portion 44 determines the amount of replenishing toner.

A toner replenishment controlling portion 49 controls the toner replenishing apparatus 35 in accordance with the amount of toner to be replenished, which is determined by the toner replenishing amount determining portion 44, and thereby the replenishment of toner to the developer contained in the developing apparatus 15 from the toner replenishing apparatus 35 is controlled so that the toner density of the developer contained in the developing apparatus 15 is appropriate. And further, a surface electric potential meter 50 measures surface electric potential of the photosensitive body 11 between the eraser 14 and the developing apparatus 15, and a temperature sensor 51 measures temperature in the vicinity of the photosensitive body 11, the P-sensor 17 and the cleaning apparatus 18.

The latent image controlling portion 48 respectively determines the exposure manipulating value and the charge manipulating value at the exposure manipulating value determining portion 46 and at the charge manipulating value determining portion 47 in accordance with the measurement value of the surface electric potential meter 50 and the measurement value of the temperature sensor 51. An exposure controlling portion 52 controls the light emitting amount of the exposing lamp 22 in accordance with the exposure manipulating value determined by the exposure manipulating value determining portion 46. A charge controlling portion 53 controls the charging amount of the photosensitive body 11 by controlling the charger 12 in accordance with the charge manipulating value determined by the charge manipulating value determining portion 47.

An ADS pattern 55 (refer to FIG. 3) reflects the light rays emitted from the exposing lamp 22, and the amount of the reflected light rays are detected by an ADS sensor 54. A developing bias controlling portion 56 controls the developing bias voltage to be applied to the developing sleeves 33 and 34 in accordance with the output value of the surface electric potential meter 50 and the output value of the ADS sensor 54.

Figure 3A:
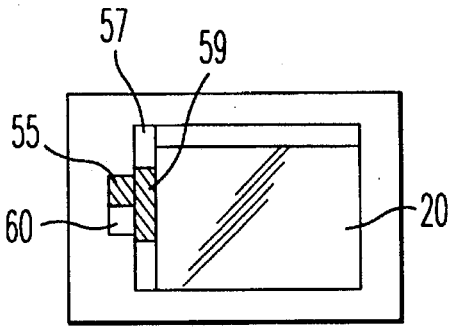
FIGS. 3*a* and 3*b* are, respectively, a back-side view and a perspective view showing the P-sensor pattern of the first example of the copying machine shown in FIG. 1.
Figure 3B:
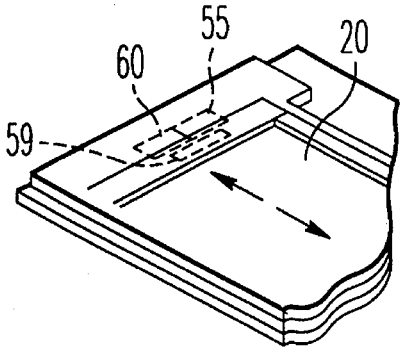

As shown in FIG. 3, a manuscript document is set on the manuscript document stand 20'such that the tip-end of the document abuts on the manuscript scale 57. A P-sensor pattern including a $V_L$ pattern 59 and a $V_D$ pattern 60 is formed on the tip-end portion of the manuscript document stand 20 (the area at the lower side of the manuscript scale 57 and at the just front side thereof). The $V_D$ pattern 60 is a darkness pattern constructed with a standard density pattern, for instance, the image pattern of large-area black, while the $V_L$ pattern 59 is a brightness pattern constructed with the background density of the photosensitive body 11 or an image pattern of low density which is a little darker than the background density of the photosensitive body 11.

In a case that the reflection density of the toner image of the P-sensor pattern formed on the photosensitive body 11 is optically detected by use of the P-sensor 17, the $V_L$ pattern 59 and the $V_D$ pattern 60 are scanned and illuminated by the exposing lamp 22 prior to the manuscript document put on the document stand 20, and the image of the reflected light rays is projected onto the photosensitive body 11 through the mirrors 23 through 25, the lens 26, and the mirrors 27 through 29. Thereby the electrostatic latent image of the P-sensor pattern is formed at the upstream side in the rotational direction of the photosensitive body 11 a little higher than the manuscript document image, without the P-sensor pattern being superposed on the electrostatic latent image. The electrostatic latent image is converted to the toner image by developing by the developing apparatus 15 without being erased by the eraser 14. The toner image of the P-sensor pattern passes through the transferring belt apparatus 16 as it is, and the density of the toner image is optically detected by the P-sensor 17. Thereafter, the toner image thereon is cleaned by the cleaning apparatus 18.

Figure 4:
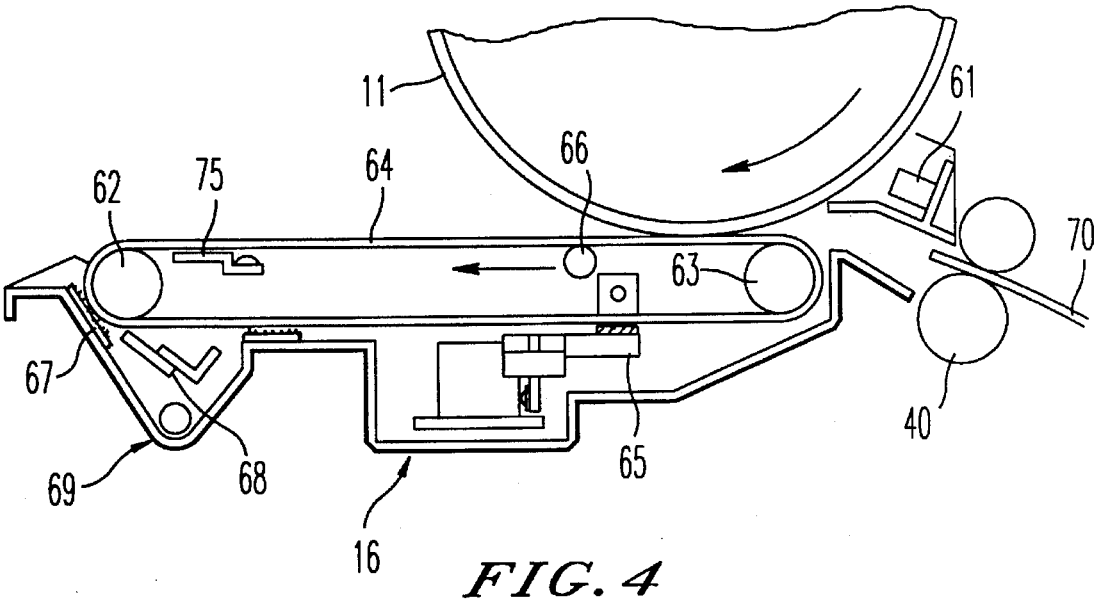
FIG. 4 is an outlined front view showing the transferring belt apparatus of the first example of the copying machine shown in FIG. 1.

As shown in FIG. 4, the transferring belt apparatus 16 includes a transferring belt 64 suspended with tension on a driving roller 62 and a driven roller 63, a contacting/detaching lever 65 which is driven in the upward direction by a sucking-in action of a plunger solenoid 72 (refer to FIG. 6) and which, when the plunger solenoid 72 is energized, brings the transferring belt 64 into contact with the photosensitive body 11, and returns in the downward direction to the initial position by the action of the spring force and thereby detaches the transferring belt 64 from the photosensitive body 11, a transferring bias roller 66 which is brought into direct contact with the inner side of the transferring belt 64 and applied with the transferring bias voltage from a DC high-voltage power source device 71 constructing a bias voltage power source device (refer to FIG. 6), a transferring belt cleaning apparatus 69 including a cleaning brush 67 and a cleaning blade 68, and a feed-back electrode 75 constructed with a contact plate brought into direct contact with the inner side of the transferring belt 64.

The transferring belt 64 is constructed with an endless belt having a resilient characteristic and constant electric resistance value. The driving roller 62 is rotatably driven by a motor and causes the transferring belt 64 to rotate.

Figure 6:
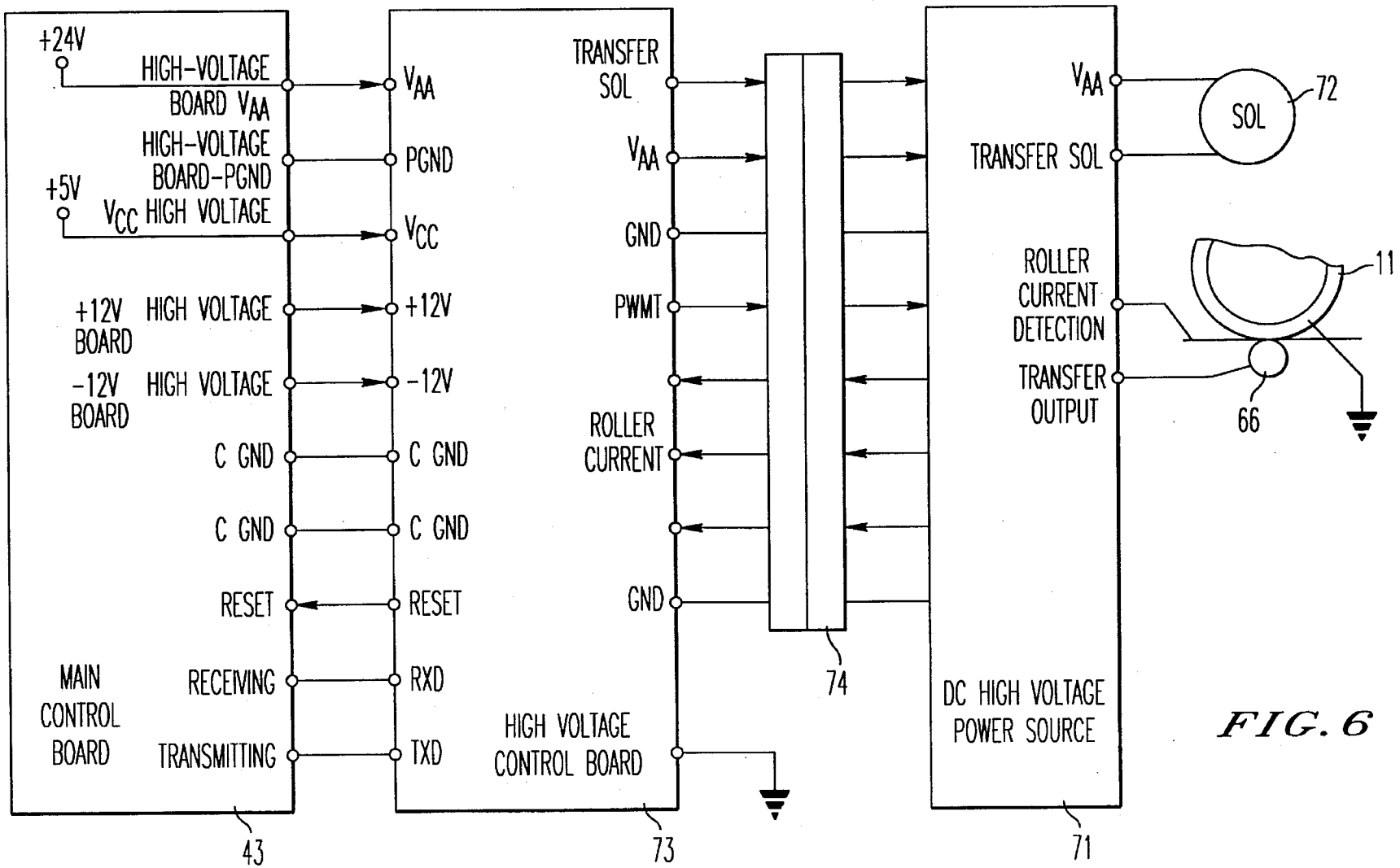
FIG. 6 is a block diagram showing a part of the first example of the copying machine shown in FIG. 1.

As shown in FIG. 6, the DC high-voltage power source device 71 drives the plunger solenoid 72, feeds back the electric current fed back from the contact plate (feed-back electrode) 75 to high voltage controlling means 73 constructed with a high voltage controlling plate, and applies the transferring bias output to the transferring bias roller 66.

The high voltage controlling means 73 controls the DC high-voltage power source device 71 through a connector 74 in accordance with the command from the main control board 43. Thereby, the transferring bias output from the DC high-voltage power source device 71 to the transferring bias roller 66 is controlled so as to make the transferring bias current constant by use of the feed-back current from the contacting plate 75.

Figure 5A:
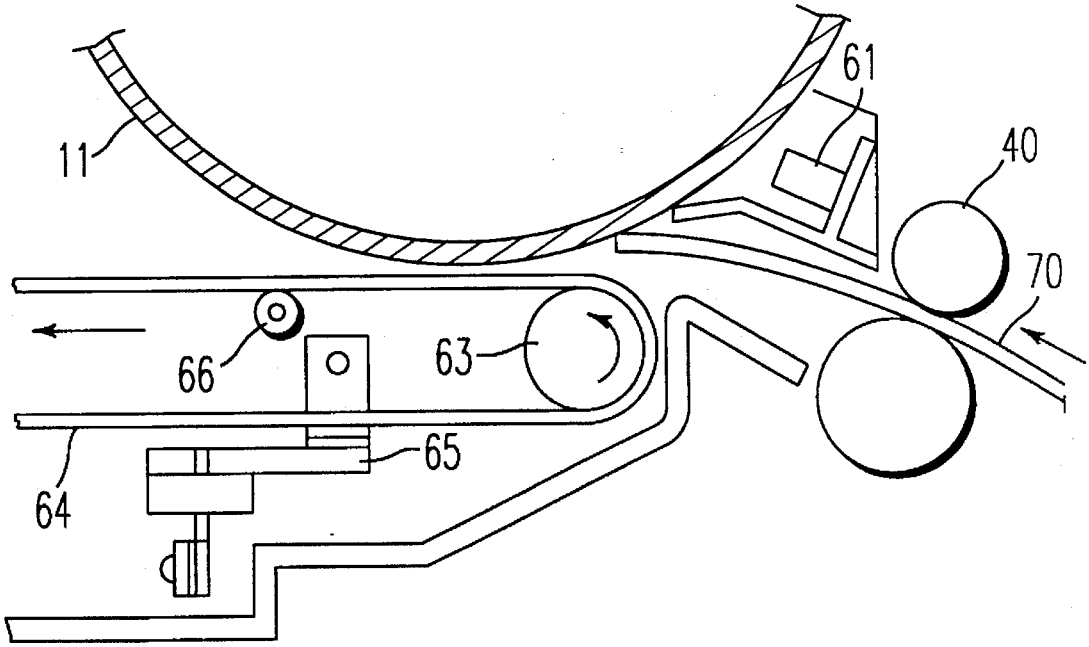
FIGS. 5*a* and 5*b* are outlined front views respectively showing the contacting and detaching states of the transferring belt apparatus of the first example of the copying machine shown in FIG. 1.

At the time of an ordinary non-transferring operation when the copying paper 70 is not transported from the registration roller 40, the plunger solenoid 72 is de-energized and thereby the transferring belt 64 is in a state of being detached from the photosensitive body 11 as shown in FIG. 5*a*.

Figure 5B:
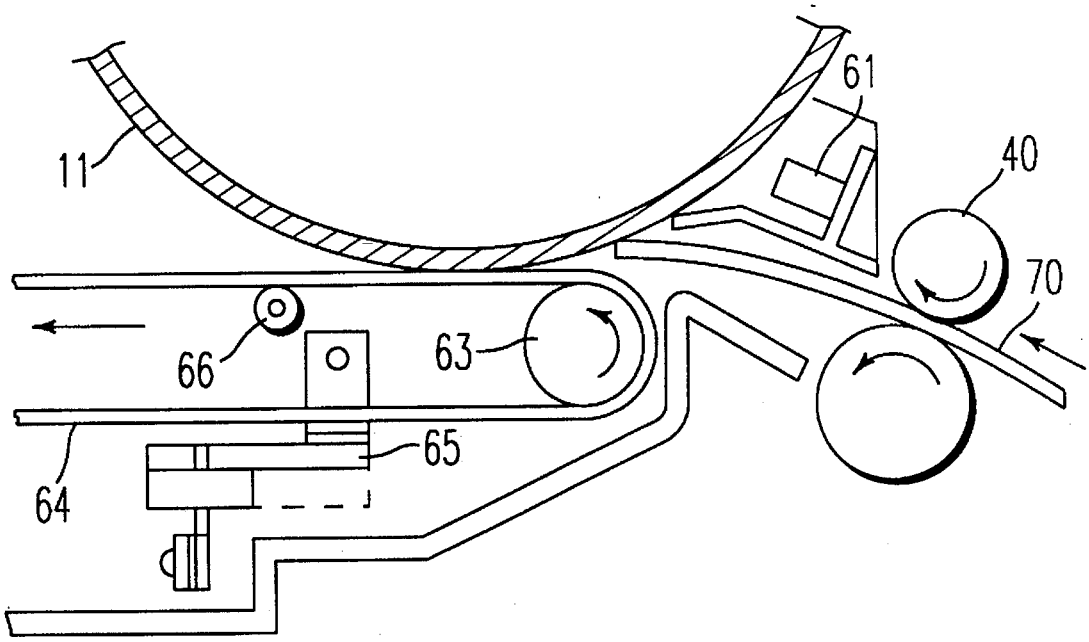

On the contrary, at the time of a transferring operation when the copying paper 70 is transported from the registration roller 40, the plunger solenoid 72 is energized and the contacting/detaching lever 65 is driven by the action of the solenoid's sucking-in force as shown in FIG. 5*b*, and thereby the transferring belt 64 is brought into contact with the photosensitive body 11 so that the transferring bias output from the DC high-voltage power source device 71 is applied to the transferring bias roller 66.

The copying paper 70 sent out from the registration roller 40 is electrostatically sucked onto the transferring belt 64. The toner image formed by the manuscript document on the photosensitive body 11 at the nipping portion between the transferring belt 64 and the photosensitive body 11 is transferred electrostatically onto the copying paper 70, and thereafter the transferring belt and the copying paper transferred with the toner image are separated from the photosensitive body 11 and are further conveyed. And further, the transferred paper is separated from the transferring belt 64 at the driving roller 62 by the action of the curvature separation due to the hardness of the copying paper 70, and the transferred paper is then conveyed to the fixing apparatus 41.

Since the P-sensor 17 is situated at the downstream side of the transferring belt apparatus 16 in the rotational direction of the photosensitive body 11, when the toner image of the P-sensor pattern is formed on the photosensitive body 11, the transferring belt 64 has to be in a state of being detached from the photosensitive body 11 as shown in FIG. 5a.

Assuming that, when the toner image of the P-sensor pattern is formed on the photosensitive body 11, the transferring belt 64 comes into contact with the photosensitive body 11, the toner image of the P-sensor pattern formed on the photosensitive body 11 is partly peeled off by the transferring belt 64, and thereby the toner is deteriorated even though the transferring bias is not applied to the transferring belt 64.

And further, at this time, in a case that an electric charge remains on the transferring belt 64, the toner image of the P-sensor pattern on the photosensitive body 11 turns out to be transferred onto the transferring belt 64. As a result, it is impossible to precisely detect the density of the toner image of the P-sensor pattern on the photosensitive body 11 by use of the P-sensor 17, so that the P-sensor cannot accurately perform the function thereof. Hereupon, in a case that the toner image of the P-sensor pattern is formed on the photosensitive body 11, the transferring belt 64 is separated from the photosensitive body 11 with certainty.

In the general cases of successively copying the manuscript document with various copying speeds; 10 cpm, 20 cpm, 30 cpm, and 40 cpm, the operational timings thereof are respectively shown by the timing charts of FIGS. 8*a* through 8*d*. Regarding the above operational timings, FIGS. 8*a* through 8*d* respectively represent the timings of the contacting/detaching state of the copying paper 70 to the photosensitive body 11 at the transferring portion at the time of transporting an A-4 size copying paper in a state of being long in the transverse direction. In FIGS. 8*a* through 8*d*, "P.T." represents a state at the time of the transferring operation.

On this occasion, the relationship between the copying speed and the paper conveying speed (process line speed) is as shown in the below-mentioned condition in Table 1.

TABLE 1

| Copying Speed (cpm) | Paper Conveying Speed (mm/s) |
|---|---|
| 10 | 100 |
| 20 | 120 |
| 30 | 180 |
| 40 | 240 |

In a case that the copying speed is low (for instance, 10 cpm), the aforementioned trouble may scarcely happen. In a case that the time interval of conveying the copying paper at the time of successive copying when the manuscript documents are copied successively is set quite uniform, the time interval TP between respective sheets of copying paper (paper time interval) is set as follows in Table 2 below:

TABLE 2

| Copying Speed (cpm) | Paper Time Interval (sec) |
|---|---|
| 20 | 1.25 |
| 30 | 0.83 |
| 40 | 0.63 |

In order to form the P-sensor pattern on the photosensitive body 11 and to carry the formed pattern to the P-sensor 17 at the downstream lower than the transferring belt apparatus 16, assuming that the distance 130 mm and the plus time of 1 second are needed as shown in the first example for separating the transferring belt 64 brought into contact with the photosensitive body 11 from the photosensitive body 11 and preventing the residual electric charge on the transferring belt 64 from exerting an influence on the others adjacent thereto, a paper time interval TLl as shown below in Table 3 is needed.

TABLE 3

| Copying Speed (cpm) | Paper Time Interval (sec) |
|---|---|
| 20 | 2.08 |
| 30 | 1.72 |
| 40 | 1.54 |

Figures 9A, 9B, 9C:
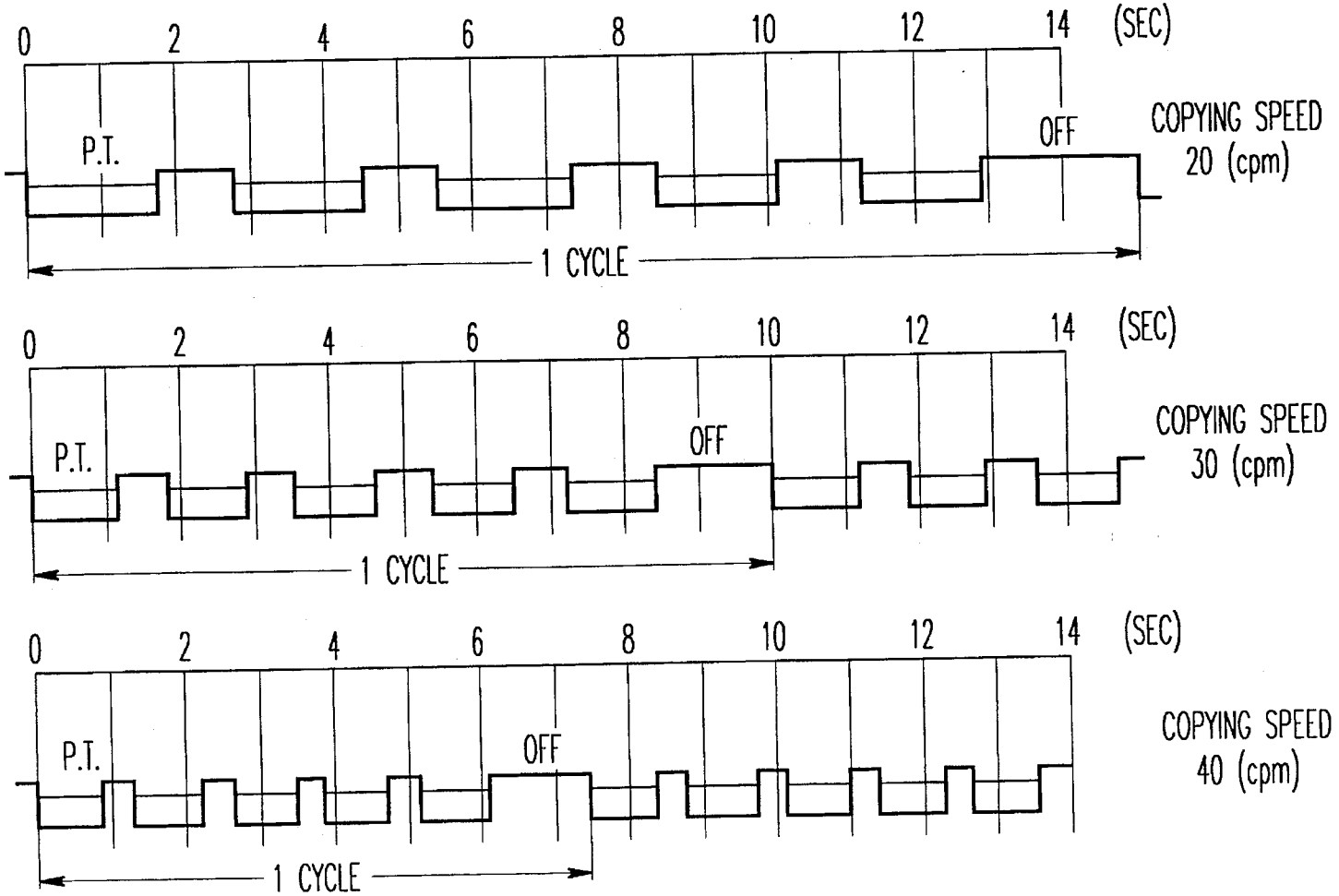
FIGS. 9*a*–9*c* are timing charts showing the timing of paper conveying in the transferring portion during the time period of successive copying operations, respectively, at the various copying speeds of the first example of the copying machine shown in FIG. 1.

On such an occasion, the first example controls the paper time interval TLl (time interval of the transferring process) as shown in FIGS. 9*a* through 9*c*. In this example, a density detection of the P-sensor pattern can be done once per five-sheets of successive copying at the time of the successive copying. The reason why the density detection of the P-sensor pattern is done once per five-sheets successive copying is that, if the transferring process time interval is set to such an interval, the time interval of detecting the P-sensor pattern's density may also be sufficient.

According to the first example, there exists a merit that, even though the productivity of copying may be increased at the specified number of the copying paper sheets, the quality of the image may not be deteriorated at all.

In this connection, regarding the above-mentioned case, a short paper time interval TS1 and a long paper time interval TLl are shown as follows in Table 4:

TABLE 4

| Copying Speed (cpm) | Short Paper Time Interval (sec) | Long Paper Time Interval (sec) |
|---|---|---|
| 20 | 1.04 | 2.08 |
| 30 | 0.61 | 1.72 |
| 40 | 0.40 | 1.54 |

As shown in FIG. 9, the first example secures the time for performing the detaching operation by use of the transferring belt apparatus 16 which detaches partly the transferring belt 64 from the photosensitive body 11. However, it is not always necessary to perform the detaching operation of the transferring belt apparatus 16 in the case of utilizing the long paper time interval.

And further, although the toner density of the developer in the developing apparatus 15 is detected by the T-sensor 42, it may be allowable to execute the density detecting operation by use of the P-sensor pattern only when the value of the above detection exceeds a certain area. Namely, it may be allowable that the judgment on whether the detaching operation of the transferring apparatus 16 exists or not for the long paper time interval is performed in accordance with the judgment result on whether the toner density of the developer does or does not exceed a constant range.

Figure 7:
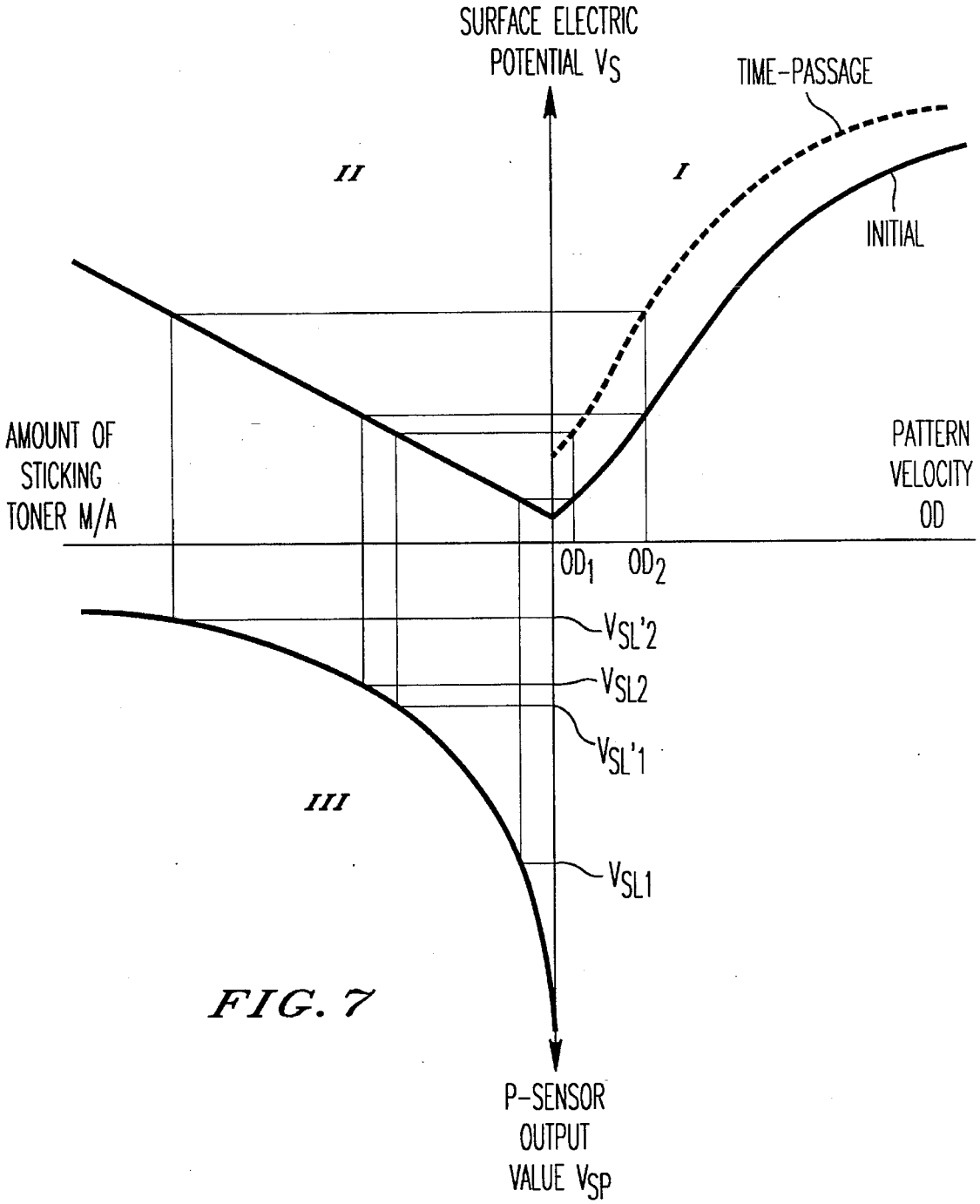
FIG. 7 is a property diagram showing the relationships from the density of the manuscript document to the output value of the P-sensor of the first example of the copying machine shown in FIG. 1.
Figures 8A, 8B, 8C, 8D:
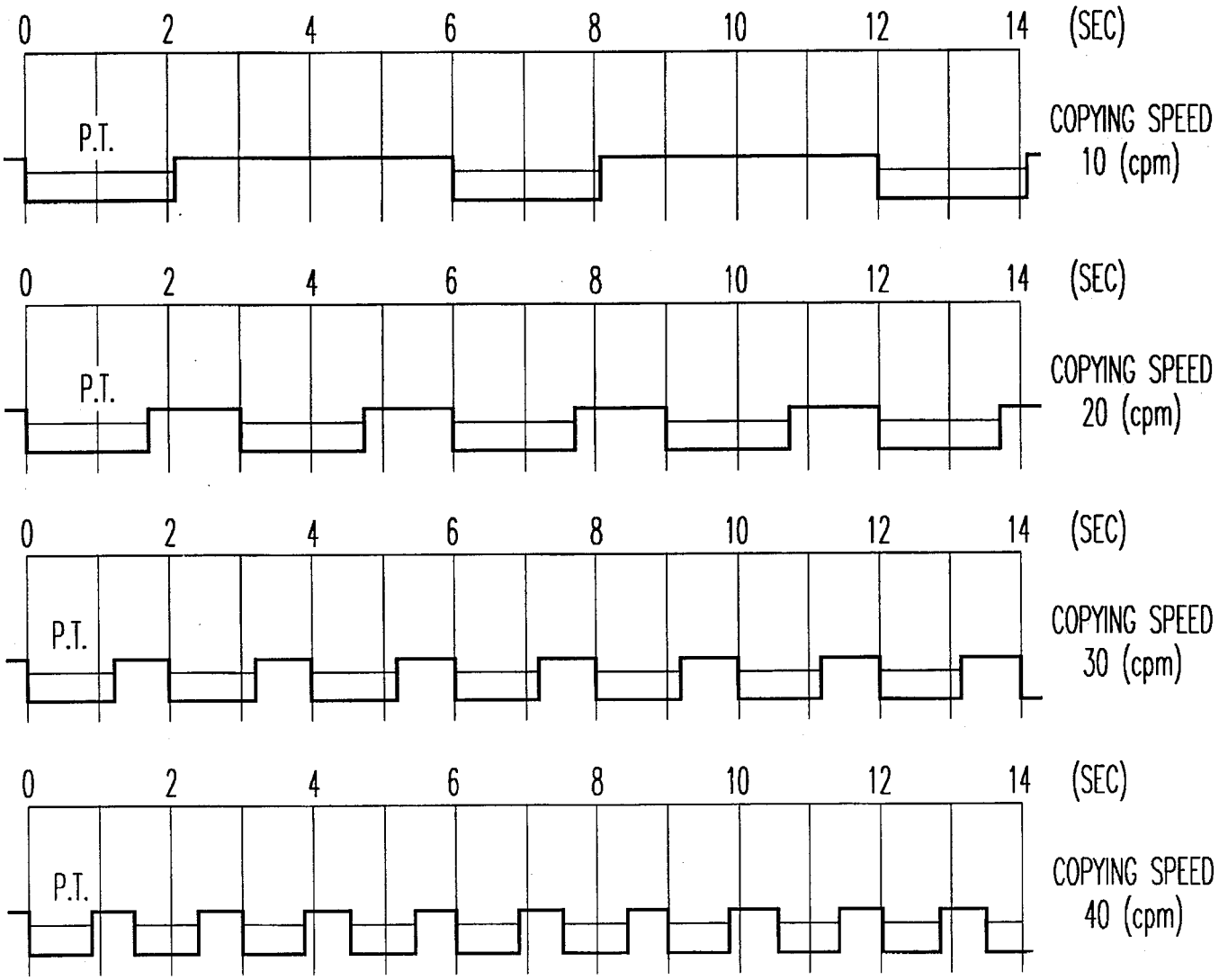
FIGS. 8*a*–8*d* are timing charts showing the timing of paper conveying in the transferring portion during the time period of successive copying operations, respectively, at the various copying speeds of the copying machine.

FIG. 7 shows the relationship between the density of the P-sensor pattern and the surface electric potential of the photosensitive body 11, the relationship between the surface electric potential of the photosensitive body 11 and the amount of sticking toner thereon, and the relationship between the amount of sticking toner on the photosensitive body 11 and the output value of the P-sensor 17.

On many occasions, the toner density tends to become excessive for the short period of time mainly due to the abnormal state of the toner replenishing operation and thereby the toner disperses out of the developing apparatus. One object of the present invention is to prevent such a troublesome obstacle from happening.

The method of the present invention of employing the T-sensor 42 in the general case for controlling the toner density by use of both of the P-sensor 17 and the T-sensor 42 solves such problems.

The object of the first example is same as the above-mentioned.

Figure 11:
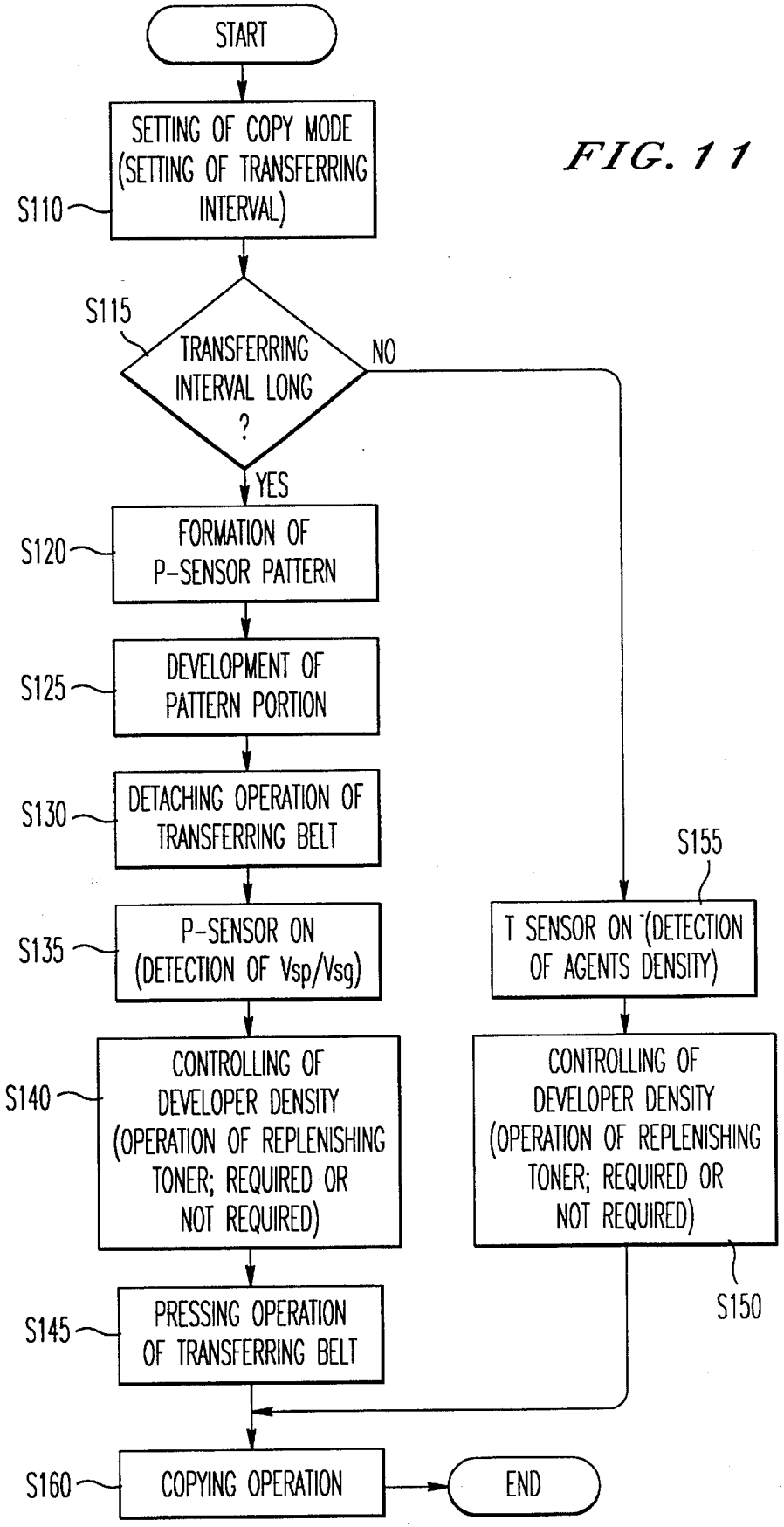
FIG. 11 is a flow chart showing the processing flow of the main control board of the first example of the copying machine shown in FIG. 1.

FIG. 11 shows the treatment flow of the main control board 43.

The main control board 43 establishes a copy mode (see step S110) by setting the copying time interval so as to take the long paper time interval once per five-times of a successive copying operation, in the case of pushing the start switch on the operation board and thereby initiating the copy operation. And further, at the time of the copying cycle when the transferring time interval (the time interval of the transferring process) is short and the short paper time interval is taken, the main control board 43 turns on the T-sensor 42 (see Step S150) and causes the T-sensor 42 to detect the permeability of the developer contained in the developing apparatus 15 and to assume the toner density of the developer.

On the basis of the output value of the T-sensor 42, the main control board 43 causes the toner replenishment control portion 49 to perform the controlling of the toner density of the developer (see step S155). On this occasion, the main control board 43, for instance, compares the output value of the T-sensor 42 with a standard value and judges the necessity of the toner replenishing operation in accordance with the result obtained by the above comparison. When the toner replenishing operation is required, the toner replenishment control portion 49 causes the toner replenishing apparatus 35 to operate, so that the toner is replenished to the developer contained in the developer container 30 from the toner replenishing apparatus 35.

Next, the main control board 43 controls the respective parts of the first example and causes those parts to perform the copying operation (see step S160) as mentioned above.

Furthermore, at the time of the copying cycle when the transferring time interval (the time interval of the transferring process) is long (see step S115) and the long paper time interval is taken, the main control board 43 controls the respective parts of the first example in order to form the toner image of the P-sensor pattern (see step S120).

On this occasion, the $V_L$ pattern 59 and the $V_D$ pattern 60 are scanned prior to the manuscript document being put on the manuscript document stand 20 and illuminated by the exposing lamp 22. The image of the reflected light rays is projected through the mirrors 23–25, the lens 26, and the mirrors 27–29 onto the photosensitive body 11, and the electrostatic latent image of the P-sensor pattern is formed at the upstream side in the rotational direction of the photosensitive body 11 without being superposed on the electrostatic latent image of the original manuscript document. The electrostatic latent image of the P-sensor pattern is converted to the toner image by developing with the developing apparatus 15 (see step S125), without being erased by the eraser 14.

And further, the main control board 43 detaches the transferring belt 64 from the photosensitive body 11 (see step S130) and turns on the P-sensor 17 (see step S135), by turning off the plunger solenoid 72 through the high-voltage control board 73, the connector 74, and the high-voltage power source device 71 and causing the contacting/detaching lever 65 to return downward.

The toner image of the P-sensor pattern then directly passes through the transferring belt apparatus 16, and the density of the toner image is optically detected by the P-sensor 17.

Next, the main control board 43 calculates the ratio Vsp/Vsg of the output value Vsp of the P-sensor 17 for the toner image of the $V_D$ pattern 60 in the P-sensor pattern and the output value Vsg Of the P-sensor 17 for the toner image of the $V_L$ pattern in the P-sensor pattern. On the basis of the ratio Vsp/Vsg, the main control board 43 causes the toner replenishment controlling portion 49 to perform the density control operation (see step S140).

On this occasion, the main control board 43 judges the necessity of the toner replenishing operation by judging whether Vsp/Vsg exists in an adequate area around the toner replenishing standard value. When the toner replenishing operation is required, the toner replenishment controlling portion 49 causes the toner replenishing apparatus 35 to operate so as to replenish the toner from the toner replenishing apparatus 35 to the developer contained in the developer container 30. Next, the main control board 43 turns on the plunger solenoid 72 through the high-voltage control board 73, the connector 74, and the DC high-voltage power source apparatus 71, and the transferring belt 64 is brought into direct contact with the photosensitive body 11 by the action of the contacting/detaching lever 65 (see step S145). In such a manner as mentioned above, the respective parts of the first example are controlled in order to perform the copying operation.

In the first example, regarding the time interval of the transferring process of transferring the toner image formed on the photosensitive body 11 onto the copying paper 70 by use of the transferring belt apparatus 16, two sorts of intervals (long interval and short interval) are established. In the case that the time interval of the transferring process is long, the transferring belt operates so as to be detached from the photosensitive body 11, the toner image of the P-sensor pattern is formed by creating the electrostatic latent image of the P-sensor pattern on the photosensitive body 11 and developing the created latent image with the developing apparatus 15 and detecting the density of the toner image of the P-sensor pattern. On the contrary, in the case that the time interval of the transferring process is short, since the electrostatic latent image of the P-sensor pattern is not created, the controlling procedure does not become complicated, and further the copying operation can be continued effectively without deteriorating the productivity of copying.

Furthermore, the time interval of the transferring process of transferring the toner image on the photosensitive body 11 onto the copying paper with the transferring belt apparatus 16 is established to the long one and the short one, and the one transferring process of the long interval is interposed between the plural transferring processes of the short interval. Only when the time interval of the transferring process is long, the transferring belt apparatus 16 operates so as to be detached from the photosensitive body 11, and the toner image is created by forming the electrostatic latent image of the P-sensor pattern on the photosensitive body 11 and developing the formed latent image with the developing apparatus 15. And further, the density of the toner image of the P-sensor pattern is detected by the P-sensor 17. Consequently, the controlling procedure is constructed with a combination of the long interval and the short interval, and thereby the control becomes simplified and the deterioration of the copying productivity can be suppressed to be a minimum.

Figure 10A:
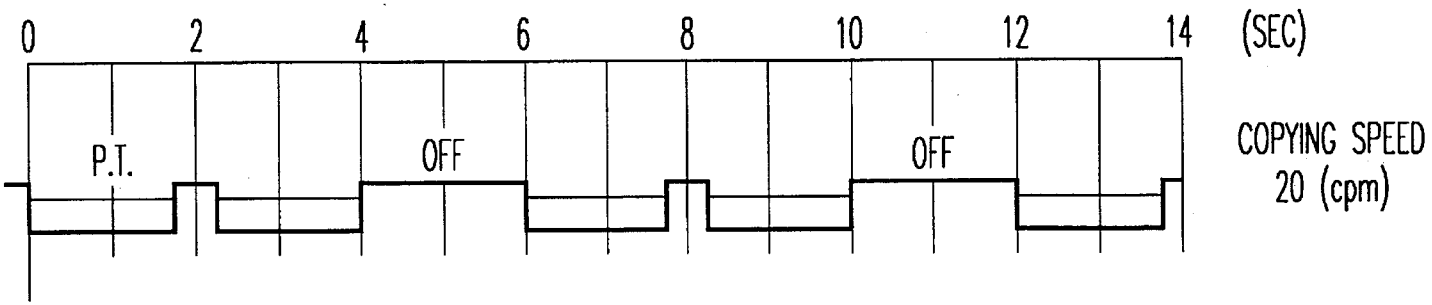
FIGS. 10*a*–10*b* are timing charts showing the timing of paper conveying in the transferring portion during the time period of successive copying operations, respectively, at the various copying speeds of the second example of the copying machine applying the third embodiment of the present invention.
Figure 10B:
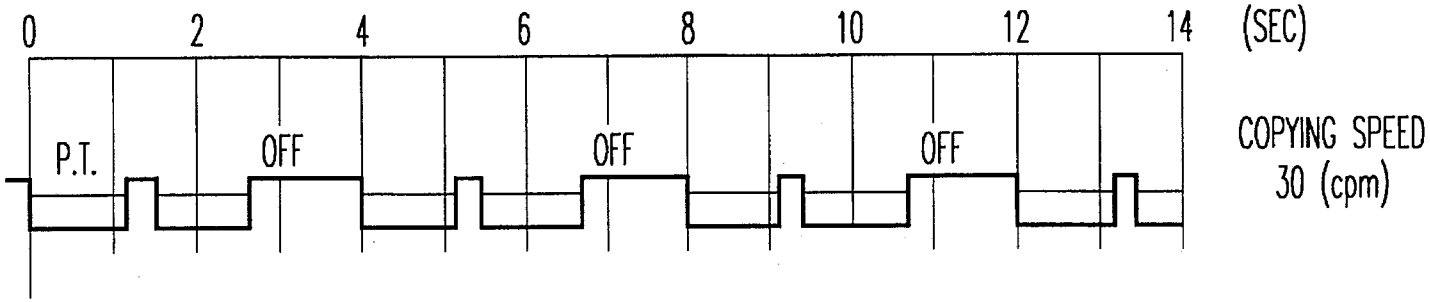

A second example of the electrophotographic-type image forming apparatus constructed with the electrophotographic-type copying machine applying the third embodiment of the present invention is now described below. In the above-mentioned first example, in a case that the copying speed is low, the long paper time interval and the short paper time interval are arranged alternately and the transferring belt 64 is detached from the photosensitive body 11 when the paper time interval is long. FIGS. 10*a* and 10*b* show the operational timings thereof. In the second example, the paper time interval is established as follows in Table 5:

TABLE 5

| Copying Speed (cpm) | Short Paper Time Interval (sec) | Long Paper Time Interval (sec) |
|---|---|---|
| 20 | 0.42 | 2.08 |
| 30 | 0.33 | 1.33 |

In a case that the copying speed is 30 cpm, in the first example 1.72 seconds is required essentially for the long paper time interval. However, in the second example, only 1.33 seconds is secured. For this reason, it follows that a margin before and after the timing for detecting the density of the P-sensor pattern by use of the P-sensor 17 decreases, and another margin of the contacting/detaching operation by the transferring belt apparatus also decreases. Those numerical values are the ones within the range which can be used for sufficient operation by improving the timing accuracy or the like.

And further, the short paper time interval is restricted by the returning time from the termination of scanning the manuscript document mainly by the movable optical system to the second-time going-back of the movable optical system to the home position thereof. Basically, the short paper time interval depends on the magnitude of the acceleration when the velocity of the movable optical system increases or decreases. In general, it is possible to set the ratio of the acceleration of the movable optical system at the time of returning and going forward to a value of a little smaller than six times. In the second example, when the copying speed is 30 cpm, the short paper time interval turns out to be almost 0.2 seconds. Consequently, the abovementioned short paper time interval of 0.33 seconds is the numerical value which can be reduced a little.

In the second example, the time interval of the transferring process of transferring the toner image formed on the photosensitive body 11 onto the copying paper 70 by use of the transferring belt 64 is set to two values (long one and short one), and the long-interval transferring process and the short-interval transferring process are performed alternately. Only when the time interval of the transferring process is long, the transferring belt 64 operates so as to be detached from the photosensitive body 11, and further the electrostatic latent image of the P-sensor pattern is formed on the photosensitive body 11, and the formed latent image is developed to the toner image of the P-sensor pattern by use of the developing apparatus 15. The density of the toner image of the P-sensor pattern is detected by the P-sensor 17. Consequently, the procedure of the long interval transferring process and that of the short interval transferring process are repeatedly performed, and therefore the control thereof turns out to be a periodically-performed one. In consequence, the control procedure becomes further simplified compared with the case in which a one-time long paper time interval is taken per plural-times successive copying operations.

Figure 12:
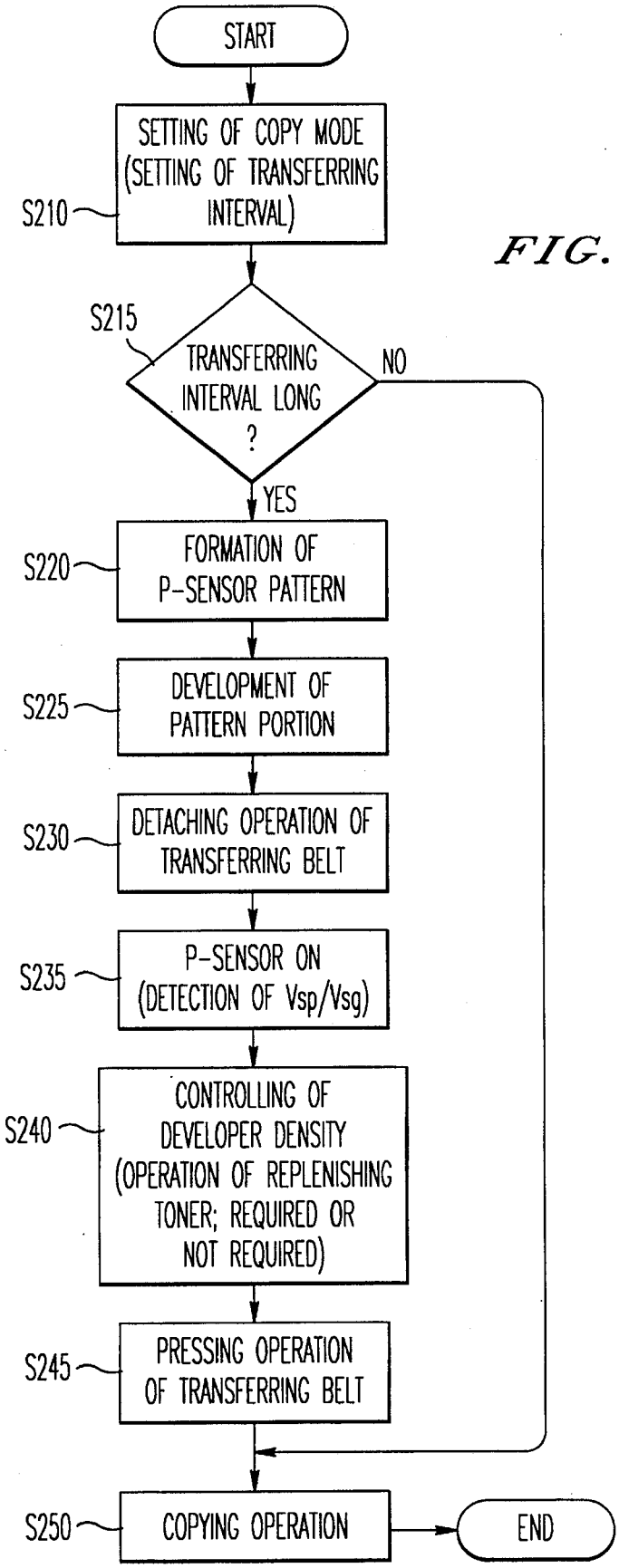
FIG. 12 is a flow chart showing the processing flow of the main control board of the other example of the copying machine applying the embodiment of the present invention.

In the aforementioned first and second examples, at the time of performing the copying cycle of short transferring time interval (time interval of the transferring process) taking the short paper time interval, the operation of controlling the density of the developer (toner density) is performed in accordance with the output value of the T-sensor electrophotographic-type image forming apparatus constructed with the electrophotographic-type copying machine applying the present invention, as shown in FIG. 12. As shown in FIG. 12, the main control board 43 controls the respective parts in the above first and second examples so as to perform the above-mentioned copying operation without performing the density control operation for the toner developer on the basis of the output value of the T-sensor 42 in a case that the transferring time interval is the short interval.

In the above-mentioned first example, the one-time long paper time interval is taken per the five-times of a successive copying operation. However, third and fourth examples of the electrophotographic-type image forming apparatus constructed with the electrophotographic-type copying machine applying fifth and sixth embodiments of the present invention perform the judgment on whether the output value of the T-sensor in the developing apparatus 15 departs from the predetermined density detection range respectively in the aforementioned first and second examples, and the same perform the judgment on whether the detection value of the P-sensor pattern density detected by the surface electric potential meter 50 and the detection value of the surface electric potential on the photosensitive body 11 depart from the predetermined relationship respectively in the above examples.

In a case that the output value of the T-sensor 42 departs from the predetermined density detection range, and in a case that the detection value of the P-sensor pattern density and the detection value of the surface electric potential on the photosensitive body 11 depart from the predetermined relationship, the above-mentioned number of times can be changed by issuing a command of executing the operations of detecting the P-sensor pattern density. Furthermore, during the time period of successive copying operations for one minute, the number of the detecting operations by the P-sensor 17 and the long and short paper time intervals are prescribed by the equalities respectively shown below under the operational condition:

m: Number of the transported Copying Paper Sheets successively copied for one minute (cpm), VP: Velocity of transporting the Copying Paper Sheets (mm/s), LP: Length of the transported Copying Paper Sheets in the transporting direction (mm), Ta: Time Interval to be secured regardless of the paper transporting time in the contacting/detaching operation of the transferring belt apparatus (sec), LB: Length of the P-sensor Pattern on the Photosensitive Body 11 required for reading out the P-sensor Pattern (mm), Assuming that the respective symbols represent the above-mentioned, the long paper time interval TL (sec) and the short paper time interval TS (sec) are respectively prescribed by the following equalities.

$$TL=LB/VP+Ta(\text{sec}) \quad (1)$$

$$TS=[\{5\times(60/m)-TL\}-5\times(LP/VP)]/4(\text{sec}) \quad (2)$$

And further, TS is prescribed by the following equality obtained by putting the above equality into order.

$$TS=\{5\times(60/m-LP/VP)-TL\}/4(\text{sec}) \quad (3)$$

In this example, the driving power source for contacting the transferring belt 64 to the photosensitive body 11 and detaching the transferring belt 64 from the photosensitive body 11 is the plunger solenoid 72 which is driven by the electric power supplied by the bias voltage source apparatus 71 of the transferring belt apparatus 16.

In the third example, the judgment on whether the electrostatic latent image formation for the P-sensor pattern, development of the latent image, and the detection of the density of the developed image should be performed for the case in which the time interval of the transferring process is long is done in accordance with whether the toner density of the developer in the developing apparatus 15 departs from the predetermined density range, in the first example. Consequently, it is possible to perform the contacting/detaching operation of the transferring belt apparatus and the detecting operation for detecting the toner density with necessary minimum. Furthermore, the toner can be prevented from dispersing, and the number of the repetitive contacting/detaching operations turns out to be reduced. As a result, the reliability of the apparatus is raised (improved) and a reasonable control system can be realized.

Furthermore, in the fourth example, the judgment on whether the electrostatic latent image formation for the P-sensor pattern, development of the latent image, and the detection of the density of the developed image should be performed for the case in which the time interval of the transferring process is long is done in accordance with whether the toner density of the developer in the developing apparatus 15 departs from the predetermined density range, in the second example. Consequently, the control of the fundamental pattern is performed repeatedly, so that the control can be simplified, and further it is possible to make the contacting/detaching operation of the transferring belt apparatus and the detecting operation for detecting the toner density necessary minimum. Furthermore, the toner can be prevented from dispersing, and the number of the repetitive contacting/detaching operations turns out to be reduced. As a result, the reliability of the apparatus is raised (improved) and a reasonable control system can be realized.

In the other example of the electrophotographic-type image forming apparatus constructed with the electrophotographic-type copying machine applying the fourth embodiment of the present invention, the one-time long-interval transferring process is interposed between the plural (n)-times short-interval transferring processes in the aforementioned first example. The range of "n" is at least $n \geqq 5$. In order to secure the prescribed number of copying paper sheets to be successively copied for one minute, the n-times short paper time intervals and the one-time long paper time interval are set respectively. In this example, securing the minimum number required for the toner density detection, the times number of contacting/detaching to or from the photosensitive body 11 of the transferring belt 64 can be suppressed. And further, the probability of the troublesome happenings and occurrences such as dispersing of toner can be reduced, and there is no fear of deteriorating the productivity of the copying.

Hereupon, the present invention is not limited to the aforementioned examples. For instance, the present invention can be applied to the electrophotographic-type image forming apparatus such as a facsimile device, various sorts of printer, etc. having a dry-type developing apparatus.

The first embodiment of the present invention thus operates such that the time interval of the transferring process for transferring the toner image on the photosensitive body onto the copying paper by use of the transferring belt apparatus is established, respectively, to long and short intervals. In a case that the time interval of the transferring process is long, the transferring belt apparatus is detached from the photosensitive body and at the same time the toner image of a standard density pattern is formed by forming an electrostatic latent image of the standard density pattern on the photosensitive body and forming the toner image of the standard density pattern by developing the latent image by use of the developing means. Then, density of the toner image of the standard density pattern is detected by the density detection means.

On the contrary, in a case that the time interval of the transferring process is short, the formation of the electrostatic latent image of the standard density pattern is not performed.

Consequently, the controlling procedure does not become complicated and the image forming operation can be effectively continued without deteriorating the productivity of the object having the image formed thereon.

The second embodiment of the present invention thus operates such that the time interval of the transferring process for transferring the toner image on the photosensitive body onto the copying paper by use of the transferring belt apparatus is established, respectively, to long and short intervals and the one-time long transferring process is interposed between the plural-times short transferring processes. Only in a case that the time interval of the transferring process is long the transferring belt apparatus is detached from the photosensitive body and at the same time the toner image of a standard density pattern is formed by forming the electrostatic latent image of the standard density pattern on the photosensitive body and forming the toner image of the standard density pattern by developing the latent image by use of the developing means. Then, the density of the toner image of the standard density pattern is detected by the density detection means.

On the contrary, in a case that the time interval of the transferring process is short, the formation of the electrostatic latent image of the standard density pattern is not performed.

Consequently, the controlling procedure is constructed with a combination of the long-interval procedure and the short-interval procedure, and thereby the control becomes simplified. Furthermore, the deterioration of the image-formed object's productivity can be suppressed to be a minimum.

The third embodiment of the present invention thus operates such that the time interval of the transferring process for transferring the toner image on the photosensitive body onto the copying paper by use of the transferring belt apparatus is established, respectively, to long and short intervals and the long-interval transferring process and the short interval transferring process are performed alternately. Only in a case that the time interval of the transferring process is long the transferring belt apparatus is detached from the photosensitive body and at the same time the toner image of a standard density pattern is formed by forming the electrostatic latent image of the standard density pattern on the photosensitive body and forming the toner image of the standard density pattern by developing the latent image by use of the developing means. Then, the density of the toner image of the standard density pattern is detected by the density detection means.

On the contrary, in a case that the time interval of the transferring process is short, the formation of the electrostatic latent image of the standard density pattern is not performed.

Consequently, the controlling procedure turns out to become the repetition including the procedure of the long-interval transferring process and that of the short-interval transferring process, and thereby the control thereof turns out to be a periodically-performed one.

Furthermore, the controlling procedure becomes further simplified compared with the case of performing the one-time control for the plural-times image forming operations.

According to the fourth embodiment of the present invention, in a system of controlling the toner density detection of the electrophotographic-type image forming apparatus as described in the first or second embodiments of the present invention, in order to attain the above-mentioned objects, the fourth embodiment of the present invention operates such that, in a case that the one-time long-interval transferring process is interposed between the plural-times (n-times) short-interval transferring processes, the value n is not smaller than at least five ($n \geqq 5$), and the short interval time for the paper of n times and the long interval time of one time are respectively established such that the number of the paper sheets on which the image is formed successively per one minute can secure the prescribed number.

Consequently, securing the times number of the minimum-extent contacting/detaching operations of the transferring belt required for performing the toner density detection, the times number of the contacting/detaching operations of the transferring belt is suppressed, and thereby the probability of the troublesome happenings or occurrences such as dispersing of toner, etc. can be reduced. Furthermore, the productivity of the image-formed object is not deteriorated at all.

According to the fifth embodiment of the present invention, in a system of controlling the toner density detection of the electrophotographic-type image forming apparatus as described in the first or second embodiments of the present invention, in order to attain the above-mentioned objects, the fifth embodiment of the present invention operates such that it is possible to judge whether forming the electrostatic latent image of the standard density pattern, developing the latent image thus formed, and detecting the density of the developed image should be performed for the case of the long time interval in the transferring process, in accordance with the fact whether the density of the toner as the developing agents in the image developing means deviates (departs) from the predetermined density range.

Consequently, the contacting/detaching operations of the transferring belt apparatus and the detecting operation of detecting the toner density can be made necessarily minimum. And further, it is possible to prevent the toner from dispersing and to minimize the times number of the contacting/detaching operations of the transferring belt apparatus and raise the reliability thereof. In such a manner, the control system can be made reasonable.

According to the sixth embodiment of the present invention, in a system of controlling the toner density detection of the electrophotographic-type image forming apparatus as described in the third embodiment of the present invention, in order to attain the above-mentioned objects, the sixth embodiment of the present invention operates such that it is possible to judge whether forming the electrostatic latent image of the standard density pattern, developing the latent image thus formed, and detecting the density of the developed image should be performed for the case of the long time interval in the transferring process, in accordance with the fact whether the density of the toner as the developing agents in the image developing means deviates (departs) from the predetermined density range.

Consequently, the control turns out to be a repetitive control of the fundamental pattern and the control procedure becomes simplified.

Furthermore, the times number of the contacting/detaching operation of the transferring belt apparatus and that of the toner density detecting operation turn out to be necessarily minimum, and thereby the reliability thereof can be raised. In such a manner, the control system can be made reasonable.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the U.S. is:

1. A method of controlling toner density detection of an electrophotographic-type image forming apparatus comprising a rotatable photosensitive body, forming means for forming an electrostatic latent image and standard density pattern on said photosensitive body, developing means for forming a toner image by developing said electrostatic latent image and standard density pattern on said photosensitive body, a transferring belt apparatus for transferring said toner image on said photosensitive body onto copying paper sheets through a transfer belt, density detection means for detecting a density of said toner image of said standard density pattern on said photosensitive body at a downstream side of said transferring belt apparatus in relation to a rotational direction of said photosensitive body, comprising the steps of:

establishing a time interval for a transferring process for transferring said toner image on said photosensitive body onto said copying paper by use of said transferring belt apparatus, respectively, to long and short intervals;

detaching said transferring belt from said photosensitive body only in a case that the time interval is the long interval and at a same time of forming the latent image forming the standard density pattern on the photosensitive body, and forming the toner image of said standard density pattern by developing said latent image and standard density pattern by use of said developing means;

detecting a density of said toner image of said standard density pattern; and in a case that the time interval of the transferring process is the short interval, the formation of said electrostatic latent image of said standard density pattern is not performed.

2. A method of controlling the toner density detection of the electrophotographic-type image forming apparatus as defined in claim 1, wherein, in a case that a one-time long-interval transferring process is interposed between n plural-times short-interval transferring processes, where n is an integer, said value n is not smaller than at least five ($n \geqq 5$), and said short-interval time for the copying paper sheets of n times and said long-interval time of one time are respectively established such that a number of the copying paper sheets on which the toner image is formed successively per one minute is a predetermined number.

3. A method of controlling the toner density detection of the electrophotographic-type image forming apparatuses as defined in claim 1, further comprising the step of judging whether the steps of forming said electrostatic latent image of said standard density pattern, developing said latent image thus formed, and that of detecting the density of the developed image should be performed for the case of the long time interval in the transferring process, in accordance with whether the density of the toner in said developing means deviates from a predetermined density range.

4. A method of controlling toner density detection of an electrophotographic-type image forming apparatus comprising a rotatable photosensitive body, latent image forming means for forming an electrostatic latent image and a standard density pattern on said photosensitive body, developing means for forming a toner image by developing said electrostatic latent image and said standard density pattern on said photosensitive body, a transferring belt apparatus for transferring said toner image on said photosensitive body onto copying paper sheets through a transferring belt, and density detection means for detecting a density of said toner image of said standard density pattern on said photosensitive body at a downstream side of said transferring belt apparatus in relation to a rotational direction of said photosensitive body, comprising the steps of:

establishing a time interval of a transferring process for transferring said toner image on said photosensitive body onto said copying paper by use of said transferring belt apparatus, respectively, to long and short intervals, and a one-time long interval transferring process is interposed between plural short transferring processes;

detaching said transferring belt apparatus from said photosensitive body only in a case that the time interval is the long interval and at a same time of forming the latent image forming the standard density pattern on the photosensitive body, and forming the toner image of said standard density pattern by developing said latent image and standard density pattern by use of said developing means;

detecting a density of said toner image of said standard density pattern by said density detection means; and in a case that the time interval of the transferring process is the short interval, the formation of said electrostatic latent image of said standard density pattern is not performed.

5. A method of controlling the toner density detection of the electrophotographic-type image forming apparatus as defined in claim 4, wherein, in a case that a one-time long-interval transferring process is interposed between n plural-times short-interval transferring processes, where n is an integer, said value n is not smaller than at least five ($n \geqq 5$), and said short-interval time for the copying paper sheets of n times and said long-interval time of one time are respectively established such that a number of the copying paper sheets on which the toner image is formed successively per one minute is a predetermined number.

6. A method of controlling the toner density detection of the electrophotographic-type image forming apparatuses as defined in claim 4, further comprising the step of judging whether the steps of forming said electrostatic latent image of said standard density pattern, developing said latent image thus formed, and that of detecting the density of the developed image should be performed for the case of the long time interval in the transferring process, in accordance with whether the density of the toner in said developing means deviates from a predetermined density range.

7. A method of controlling toner density detection of an electrophotographic-type image forming apparatus comprising a rotatable photosensitive body, latent image forming means for forming an electrostatic latent image and a standard density pattern on said photosensitive body, developing means for forming a toner image by developing said electrostatic latent image and said standard density pattern on said photosensitive body, a transferring belt apparatus for transferring said toner image on said photosensitive body onto copying paper sheets through a transferring belt, and density detection means for detecting a density of said toner image of said standard density pattern on said photosensitive body at a downstream side of said transferring belt apparatus in relation to the rotational direction of said photosensitive body, comprising the steps of:

establishing a time interval of a transferring process for transferring said toner image on said photosensitive body onto said copying paper by use of said transferring belt apparatus, respectively, to long and short intervals, and the long-interval transferring process and the short-interval transferring process are performed alternately;

detaching said transferring belt apparatus from said photosensitive body only in a case that the time interval is the long interval and at a same time of forming the latent image forming the standard density pattern on said photosensitive body, and forming the toner image of said standard density pattern by developing said latent image and standard density pattern by use of said developing means;

detecting a density of said toner image of the standard density pattern by said density detection means; and in a case that the time interval of the transferring process is the short interval, the formation of said electrostatic latent image of said standard density pattern is not performed.

8. A method of controlling the toner density detection of the electrophotographic-type image forming apparatus as defined in claim 7, further comprising the step of judging whether the steps of forming said electrostatic latent image of said standard density pattern, developing the latent image thus formed, and that of detecting the density of the developed image should be performed for the case of the long time interval in the transferring process, in accordance with whether the density of the toner in said developing means deviates from a predetermined density range.

9. A system of controlling toner density detection of an electrophotographic-type image forming apparatus comprising:

a rotatable photosensitive body;

latent image forming means for forming an electrostatic latent image on said photosensitive body;

developing means for forming a toner image by developing said electrostatic latent image on said photosensitive body;

a transferring belt apparatus for transferring said toner image on said photosensitive body onto copying paper sheets through a transferring belt;

control means for establishing a time interval for a transferring process for transferring said toner image on said photosensitive body onto said copying paper by use of said transferring belt apparatus, respectively, to long and short intervals, and in a case that the time interval of the transferring process is the long interval, detaching said transferring belt from said photosensitive body and at a same time of forming the latent image forming a standard density pattern on the photosensitive body, and forming a toner image of said standard density pattern by developing said latent image and standard density pattern by use of said developing means;

density detecting means for detecting a density of said toner image of said standard density pattern at a downstream side of said transferring belt apparatus in relation to a rotational direction of said photosensitive body; and wherein in a case that the time interval of the transferring process is the short interval, the formation of said electrostatic latent image of said standard density pattern is not performed.

10. The system according to claim 9, wherein the control means establishes the time interval such that a one-time long interval transferring process is interposed between plural short interval transferring processes.

11. The system according to claim 9, wherein the control means establishes the time interval such that each long interval transferring process is alternated with each short interval transferring process.

12. The system according to claim 9, wherein, in a case that a one-time long-interval transferring process is interposed between n plural short-interval transferring processes, where n is an integer, said value n is not smaller than at least five ($n \geqq 5$), and said short-interval time for the copying paper sheets of n times and said long-interval time of one time are respectively established such that a number of the copying paper sheets on which the toner image is formed successively per one minute is a predetermined number.

13. The system according to claim 9, further comprising judging means to judge whether the density of the toner in the developing means deviates from a predetermined density range.

* * * * *